United States Patent [19]

Finley

[11] Patent Number: 5,065,838

[45] Date of Patent: Nov. 19, 1991

[54] MOVABLE SUPPORT FOR WINDOW WASHERS AND THE LIKE

[76] Inventor: Arthur C. Finley, 2742 Stonefield Dr., Fultondale, Ala. 35068

[21] Appl. No.: 574,059

[22] Filed: Aug. 29, 1990

[51] Int. Cl.[5] ..... E04G 3/10; E04G 3/14

[52] U.S. Cl. ..... 182/38; 182/3; 182/142; 182/150

[58] Field of Search ..... 182/38, 37, 36, 150, 182/3, 142; 248/237

[56] References Cited

U.S. PATENT DOCUMENTS

| | | | |
|---|---|---|---|
| 654,780 | 7/1900 | Burchill | 182/37 |
| 1,423,998 | 7/1922 | Camp | 182/38 |
| 3,391,757 | 7/1968 | Duke | 182/38 |
| 3,491,851 | 1/1970 | Dutcher | 182/142 |
| 4,274,507 | 6/1981 | Williams | 182/142 |
| 4,496,027 | 1/1985 | Fisher | 182/142 |
| 4,542,804 | 9/1985 | Power | 182/38 |
| 4,773,504 | 9/1988 | Reed | 182/38 |

*Primary Examiner*—Reinaldo P. Machado

*Attorney, Agent, or Firm*—Jennings, Carter, Thompson & Veal

[57] ABSTRACT

A movable support structure from which a window washer is suspended that utilizes the parapet wall of a building as a support or runway by directing the force applied by the weight of the washer downwardly into the parapet wall. An upright frame above the parapet wall extends upwardly in substantially the same vertical plane of the parapet wall. The upright frame is supported on the parapet wall by a first set of wheels that rest on the wall. The upright frame may be further maintained on the roof by a second set of wheels that rest on the roof. The wheels roll along the roof and wall to facilitate horizontal movement of the apparatus. The horizontal movement is guided by internal and external guide rollers that engage the respective surfaces of the parapet wall. In addition, a ladder depends over the edge of the wall such that a window washer may safely step over the parapet wall and into a position to begin cleaning.

20 Claims, 7 Drawing Sheets

MOVABLE SUPPORT FOR WINDOW WASHERS AND THE LIKE

FIELD OF THE INVENTION

This invention relates to a device on the roof of a building which allows personnel to descend to wash windows, with the device being movable along the roof of the building. More particularly the present invention relates to apparatus which engage a parapet wall on a building roof top and are movable along the parapet wall and roof top, thus utilizing the wall as a support and a track-way.

BACKGROUND OF THE INVENTION

Cleaning the windows of multi-story buildings requires personnel to suspend themselves from roof tops in order to reach areas that are otherwise inaccessible. As a worker performs his duties it is necessary for him to move horizontally across the face of the building. Inventions known in the prior art facilitated this horizontal movement by attaching a scaffold to rollers that engage a track-way, gutter, or eave permanently fixed to a top portion of the side of a building.

Other inventions secure the track-way to the roof of a building. A support structure, having a boom extending over the edge of the building with a scaffold secured thereon is fixed to the track. The structure further has a means for guiding the support structure along the track. Still other inventions utilize weighted carriages having wheels thereon to support the boom structures on the roof top.

Note that the inventions of the above mentioned prior art were not designed to engage parapet walls. Indeed the boom structures supported on the roof permit the apparatus to avoid a parapet wall. There are devices in the prior art that do engage the parapet wall and utilize it as support and a runway. Such inventions in the prior art may utilize a horse-type mechanism consisting of a boom that extends over the wall and internally of the wall. The boom is supported on the parapet by a plurality of wheels and is supported on the roof by a second set of wheels, or it is tied off to the building. If it is supported on the roof by wheels, a weight is attached to its inner end to counter any tilting action. The apparatus further has outer and inner guide rollers engaging the respective surface of the wall.

Another device engaging the parapet wall utilizes a member extending along the top of the parapet wall having rollers thereon engaging the wall. A second member extends over the edge of the wall and downwardly adjacent the face of the wall, and has two rollers horizontally aligned thereon engaging the face of the wall. The second member further extends internally over the wall and downward adjacent the internal face of the wall, having rollers horizontally aligned engaging the wall upwardly offset from the external rollers.

Note in each of the devices the point of attachment of the washer's line and application of force is outward from the vertical plane defined by the wall. The force is not directly opposed, and therefore creates a tilting action into the wall that must be opposed by the force of external surface of the wall against the guide rollers. These forces against the rollers make horizontal movement difficult.

In addition, the inventions known in the prior art do not have means for the worker to climb over the wall and safely descend the wall to begin cleaning.

SUMMARY OF THE INVENTION

The objective of the present invention is to provide a movable support structure from which a window washer is suspended that utilizes the parapet wall of a building as a support and a runway by directing the force applied via the weight of the washer into the top of the parapet wall. The force applied to the line is substantially vertical and directly opposed by the parapet wall. Any tilting action is minimal and opposed by a counter force on the support structure creating a rigid body in equilibrium that is easily movable along the parapet wall with minimal friction.

A further goal is to provide such a device with a ladder that will allow the washer to safely step over the wall and get into position to begin cleaning.

Another objective is to provide a mechanism that is easily adaptable to varying heights and widths of parapet walls, and flat roof tops. Moreover, the mechanism is easily assembled and disassembled for easy transportation and shipment.

These goals are achieved through the use of a movable support structure consisting of an upright frame that extends upward from the wall in substantially the same vertical plane as the parapet wall and is sufficiently secured to the roof to safely suspend a washer therefrom. The upright is supported on the wall and roof by a plurality of wheels mounted thereto engaging the roof and wall. The wheels roll along the roof and wall to facilitate the horizontal movement of the window washer. A ladder depends from the upright frame and below the upper edge of the wall allowing a window washer to safely step over the parapet wall, into a position to begin cleaning. The horizontal movement is guided by internal and external guide rollers.

In as much as a rope is secured to the upright and lowered over the edge of the building, the force applied via the weight of the washer is directed into the parapet wall. Any horizontal component of the force is minimal. Moreover, the vertical component is directly opposed by the upper surface of the wall, thus the structure is held in equilibrium with minimal contact between guide rollers and the wall vertical surfaces allowing the structure to easily move along the top of the wall.

BRIEF DESCRIPTION OF THE DRAWINGS

Apparatus embodying features of my invention are depicted in the accompanying drawings which form a portion of this disclosure and wherein.

DESCRIPTION OF THE PREFERRED EMBODIMENT

Figure 1:
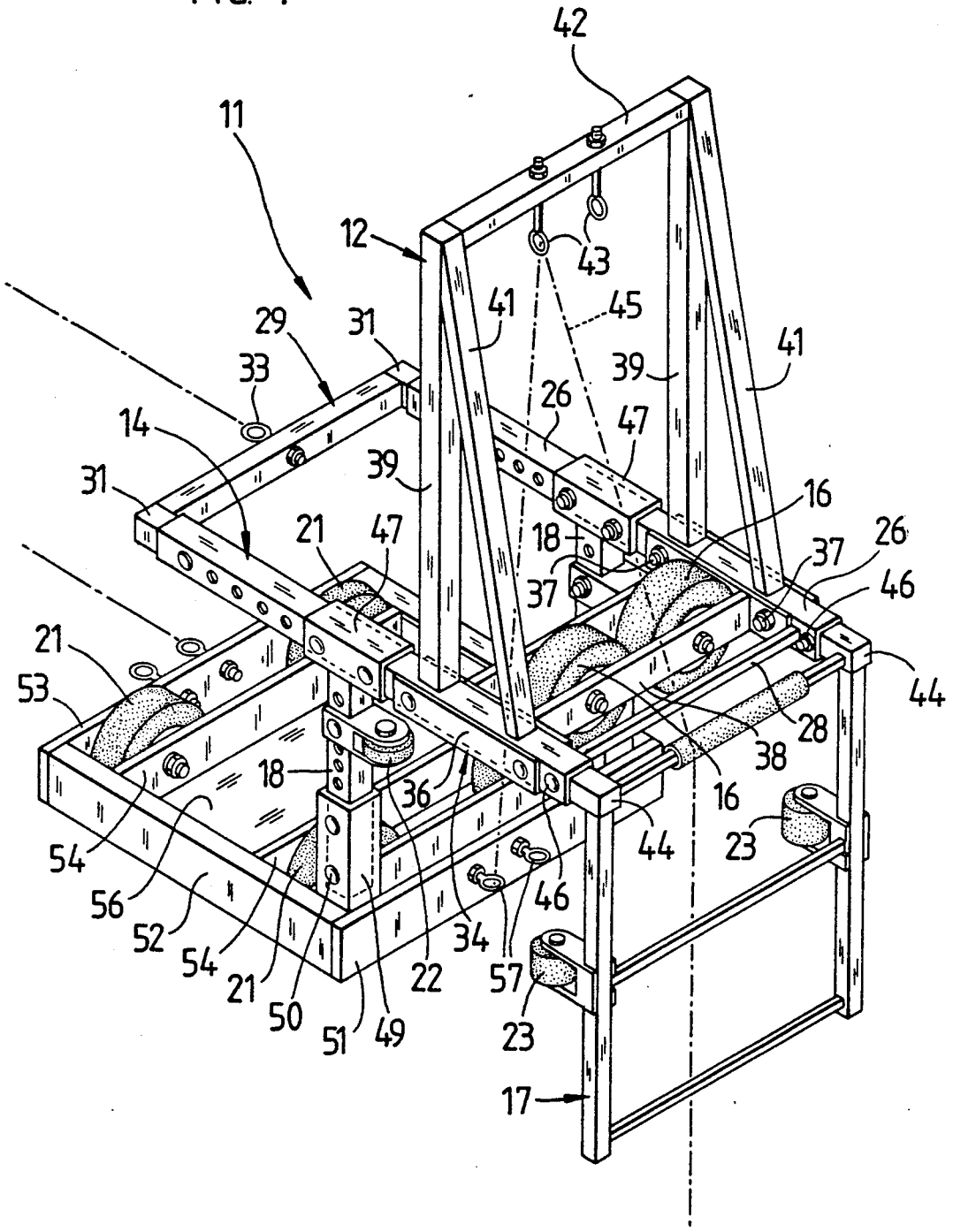
FIG. 1 is a perspective view of the invention.

Referring to the drawings for a more complete understanding of my invention, it may be appreciated that my apparatus 11 is utilized with those buildings having a parapet wall 13 extending above the roof 24 of the building. As seen in FIG. 2 the wall 13 has an inner surface adjacent the roof 24, an external surface opposite the internal surface and a top surface intermediate the internal and external surfaces. It may further be appreciated in FIGS. 1 and 2 that my invention shown generally at FIG. 1 utilizes an upright frame 12 that extends in substantially the same vertical plane of the wall 13. The upright frame 12 may be supported on the wall 13 by a horizontal frame 14 that extends over the wall having wheels 16 detachably secured thereon, to support the frame and roll along the wall 13. A ladder frame 17 is detachably mounted to the outermost ends of the horizontal frame 14, and extends below the top surface of the parapet wall 13. The upright frame 12 is further maintained on the roof 24 by an opposing pair of vertical extension legs 18 bolted to the horizontal frame 14 inwardly of the parapet wall 13 extending downwardly. The vertical extension legs 18 are detachably mounted to a balance frame 19 which is supported on the roof 24 by a second set of wheels 21 that rest on the roof top. The movement of the structure 11 along the parapet wall 13 is guided by inner rollers B22 mounted to the vertical extension legs 18 and engaging the inner surface of the wall 13, and by outer guide rollers 23 mounted to the ladder frame 17 engaging the outer surface of the parapet wall 13. Each of the above mentioned elements may be comprised of parts having various dimensions and may be made from varying materials. It is necessary that the material is sufficiently strong, such as steel or aircraft aluminum to withstand the stresses applied during the operation of my invention. In addition, the parts are interconnected so the entire apparatus remains balanced on the parapet wall and roof top to support a washer suspended therefrom.

Figure 2:
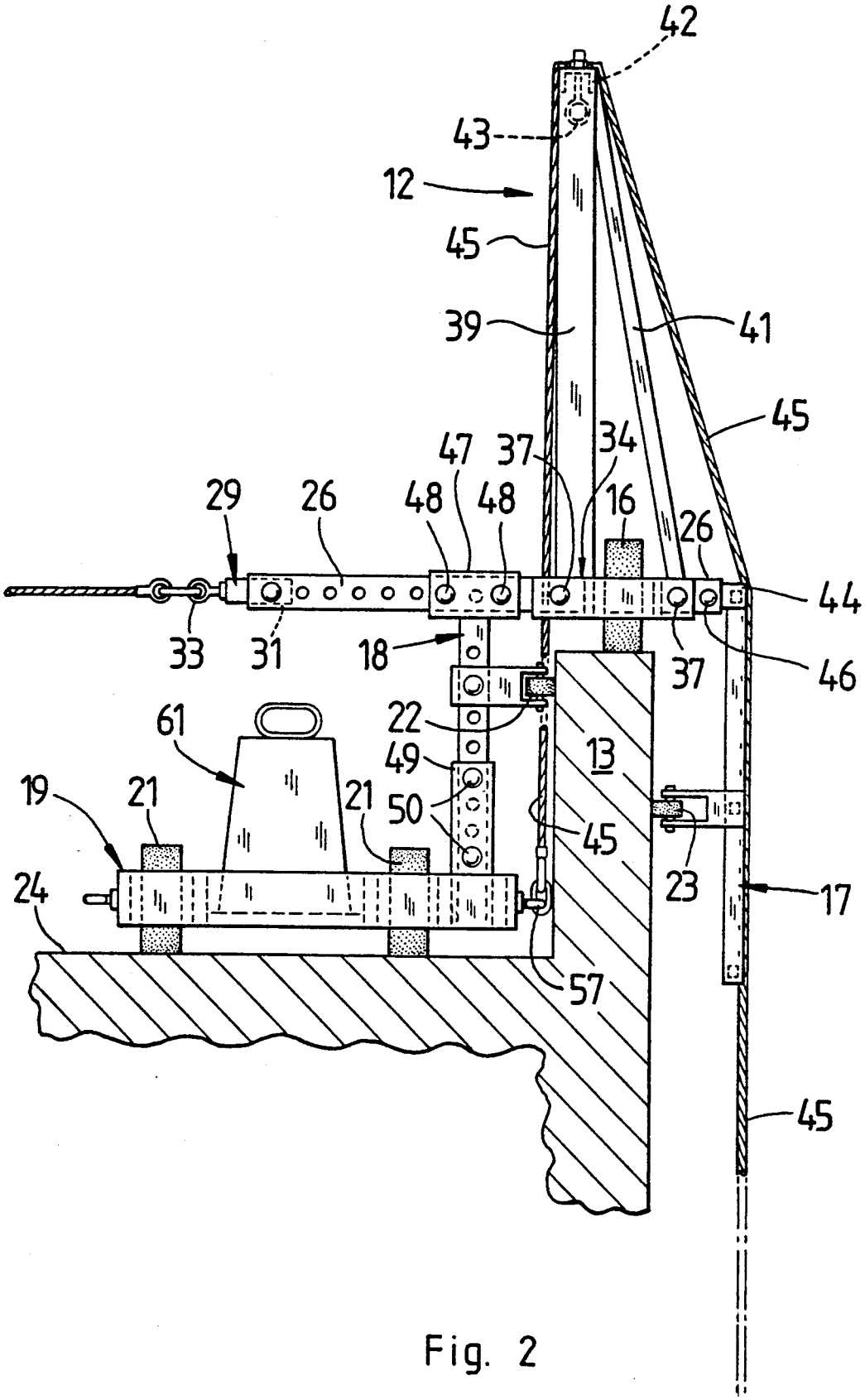
FIG. 2 is an elevational view of the invention as it is supported on a parapet wall.
Figure 4:
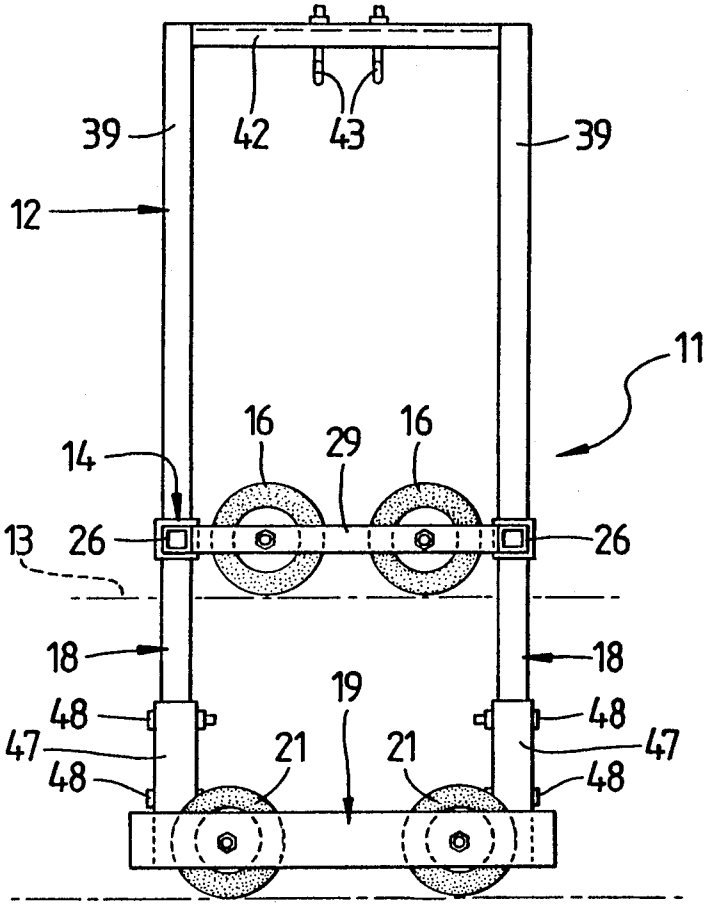
FIG. 4 is a rear elevational view of the invention.
Figure 3:
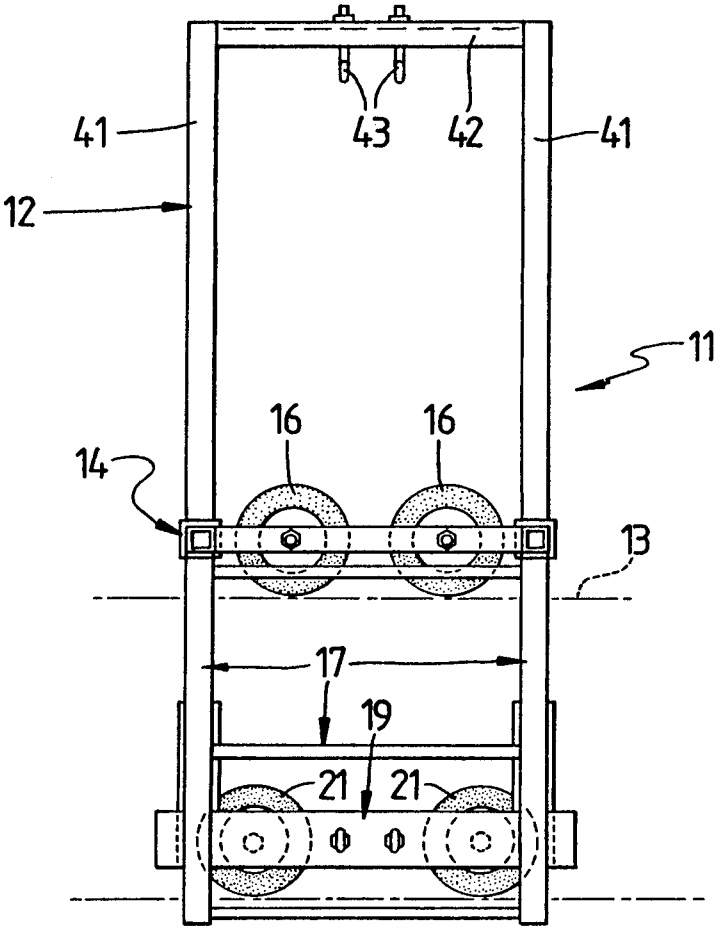
FIG. 3 is a front elevational view of the invention.

As further illustrated in FIGS. 1 and 2 the upper horizontal frame 14 may utilize an opposing pair of horizontal extension arms 26. Each arm 26 is a tubular member having a linear array of opposing pairs of apertures with said array along the length of the arm 26. The arms 26 reach from approximately the outer surface of the wall 13 inwardly, normal to the wall, with the apertures positioned such that bolts extending therethrough are parallel to the roof top. The horizontal extension arms 26 are held in fixed relation by a spacer bar 28 connected intermediate the outer ends of said arms in perpendicular relation thereto. A tie-off bar 29 may be detachably mounted to the internal ends of said horizontal arms 26 by means of mounting portions 31 inserted in each internal end of the horizontal arms 26 and secured with bolts 32, and a bar connected intermediate said mounting portion. An eyebolt 33 is horizontally centered on the tie-off bar 29 and serves as a means by which my apparatus may be tied to the building.

As mentioned above the horizontal frame 14 is supported on the wall by a set of wheels 16 that roll along the top surface of the parapet wall 13. The wheels are detachably secured to a wheel frame 34 that is mounted to a portion of the arms 26 above the top surface of the parapet wall 13. The wheel frame 34 consists of an opposing pair of channel members 36 which are attached to horizontal extension arms 26 extending therethrough and secured by bolts 37. A pair of support plates 38 are connected intermediate said channel members 36 in perpendicular relation thereto. The wheels 16 are rotatably secured to the support plates 38 and rest atop the parapet wall 13 supporting the horizontal frame 14 thereon, as shown in FIGS. 1 and 2. Note any type wheel having a sufficient traction to grip the wall may be used. It is also noteworthy to mention that the wheel should have a wide enough base so that the force applied by the weight of the washer is directed through the wheels and into the wall 13.

The upright frame 12 is welded to the horizontal extension arms 26 and extends upwardly in substantially the same vertical plane as the wall 13. As shown in FIGS. 1 and 2, the upright frame 12 may consist of two spaced vertical support members 39 each having a base welded to the horizontal extension arms 26. The vertical members 39 extend upward from the horizontal extension arms 26 parallel to each other and perpendicular to the horizontal extension arms 26. Each vertical support 39 is braced against outward deflection by a diagonal support member 41 mounted between each vertical support 39 and the horizontal extension arms 26. Mounted between the vertical support members 39 is a horizontal support member 42. A pair of eyebolts 43 depend from the horizontal support member 42 to serve as means for attaching lines 45 suspending the window washer. The pair of eyebolts are symmetrically spaced from the center of the horizontal support member 42. A line secured to the structure inwardly to the parapet wall is passed through the eyebolt and over the edge of the wall. As the eyebolts are in the vertical plane of the wall and inward of the wheels, the line of action of the rope is redirected into the wall 13 and forces applied to the ropes by the window washer are symmetrically distributed on the upright frame 12.

Also secured to the upper horizontal frame 14 is a ladder 17 that extends below the top surface of the wall 13. As shown in FIG. 1 the ladder 17 may have a mounting portion 44 that telescopically engages each horizontal extension arm 26 and is secured by bolts 46. Ladder 17 depends from each mounting portion 44 in perpendicular relation thereto and adjacent the parapet wall 13. The ladder 17 is used only in descending from the top of the wall 13 over the side into a position to begin cleaning, thus the ladder needs only approximately two steps 40 and descends about 25–30 inches. In as much as the ladder 17 is bolted to horizontal frame 14, it is removable for storing and transportation, or when the support structure 11 is used on structures having glass surfaces.

As mentioned above, the upright frame 12 is partially maintained on the roof 24 by vertical extension legs 18 which are in turn connected to the balance frame 19. Each vertical extension leg 18 has a tubular member 47 transversely welded to the top thereof for connection to the horizontal extension arm 26 inwardly of the parapet wall 13. The horizontal extension arms 26 are adjustably attached to vertical extension legs 18 through the perpendicular tubular members 47 and fastened by bolts 48. Note, the horizontal extension arm 26 is slidable within the tubular members 47, such that when the bolts 48 are removed, the horizontal arms 26 and tubular members 47 are moved in relation to each other.

Figure 7:
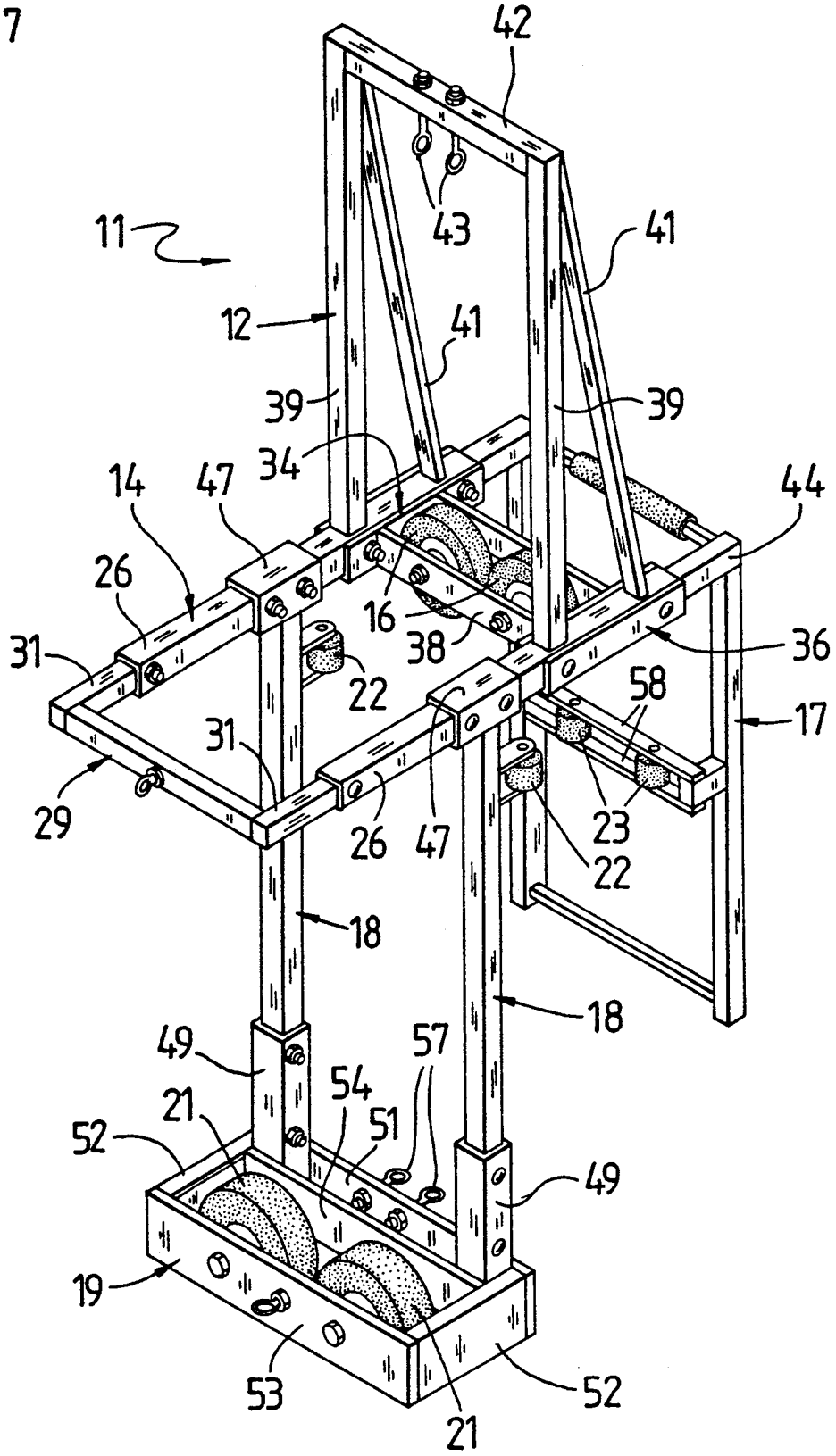
FIG. 7 is a perspective view of a modification of the first embodiment of the invention.

The vertical extension legs 18 extend downward substantially parallel the parapet wall 13 as shown in FIG. 2. Each vertical extension member 18 telescopes into a tubular member 49 which is affixed to the corners of the balance frame 19 proximal said wall 13. Note that elongated vertical extension leg 18 may be utilized for taller parapet walls as illustrated in FIG. 7. Vertical adjustment is facilitated by the vertical extension member 18 having a linear array of opposing pairs of apertures therethrough for receiving bolts 50 a shown in FIGS. 1 and 2.

In as much as the balance frame 19 serves to counter any tilting action it must be sufficiently weighted to balance the support structure on the roof. Thus the balance frame 19 includes a heavy plate 51 parallel to the parapet wall with channel members 52 mounted to each end of the plate 51 and extending inwardly of the wall in perpendicular relation to the plate 51 to a second heavy plate 53 that is parallel said first plate 51. Note that as the vertical extension leg 18 is detachably secured to the balance frame 19, the operator may utilize whatever length balance frame 19 is necessary to accommodate the roof top. As shown in FIG. 7 a shorter base frame 19 may be utilized to avoid obstacles on the roof that are close to the wall.

Figure 5:
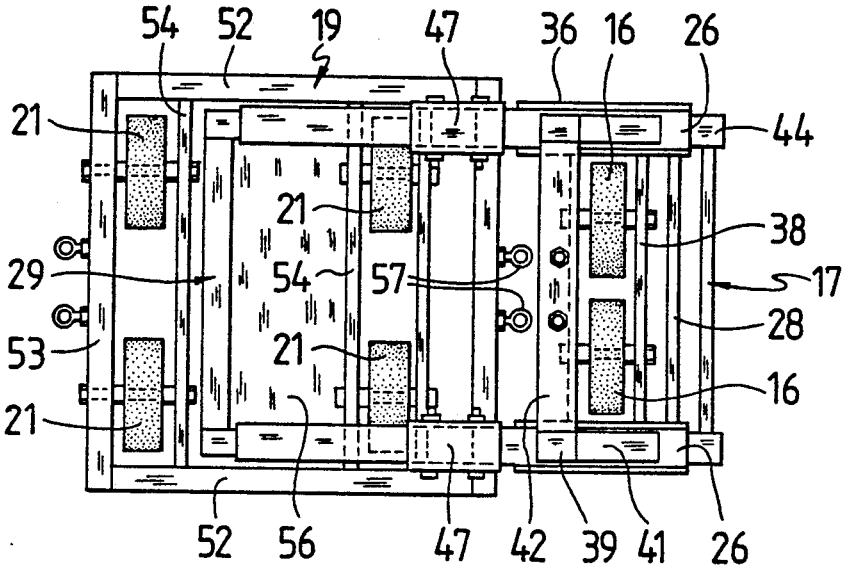
FIG. 5 is a plan view of the invention.

The balance frame 19 is supported on the roof by at least one set of wheels 21 which are mounted to wheel plates 54 connected intermediate the channel members 52 in perpendicular relation thereto. A counterweight support plate 56 is connected intermediate said channel members 52 in perpendicular relation thereto. As illustrated in the embodiment shown in FIGS. 1, 2 and 5, my invention may have balance frame 19 requiring two sets of wheels 21 with the counterweight frame disposed therebetween at sufficient length from the first steel plate to counter any tilting action of the apparatus applied by the weight of the window washer. A shorter balance frame 19 may utilize only a single wheel frame with the counterweight support 56 mounted intermediate the vertical extension legs 18. Note that the counterweight support plate 56 is optional as an additional safety feature. If properly constructed the entire weight of the balance frame itself will sufficiently counter any tilting action applied to my apparatus.

The balance frame 19 may further serve as a point of attachment for the work and safety lines 45. The work and safety lines may be secured to the balance frame by a pair of eyebolts 57 mounted to the first steel plate 51 of the balance frame 19. These eyebolts are in direct alignment with eyebolts 43 on the upright frame 12, such that the line may be secured thereon and pass through the eyebolts on the upright and over the wall, thus the force applied by the weight is symmetrically distributed on the steel plate 51 and upright frame 12.

My apparatus is guided along the parapet wall by a plurality of inner rollers 22 and outer rollers 23 as shown in FIG. 2. An inner roller 22 may be mounted to each vertical extension member 18 and engage the inner surface of the parapet wall 13. The outer pair of rollers 23 are mounted on the ladder 17 downwardly offset from the inner rollers 22 and engage the outer surface of the wall. Additional support may be added to the outer rollers 23 by mounting them within a support member 58 as shown in FIG. 7. Note that plastic or wooden rollers may be utilized with my invention.

Figure 8:
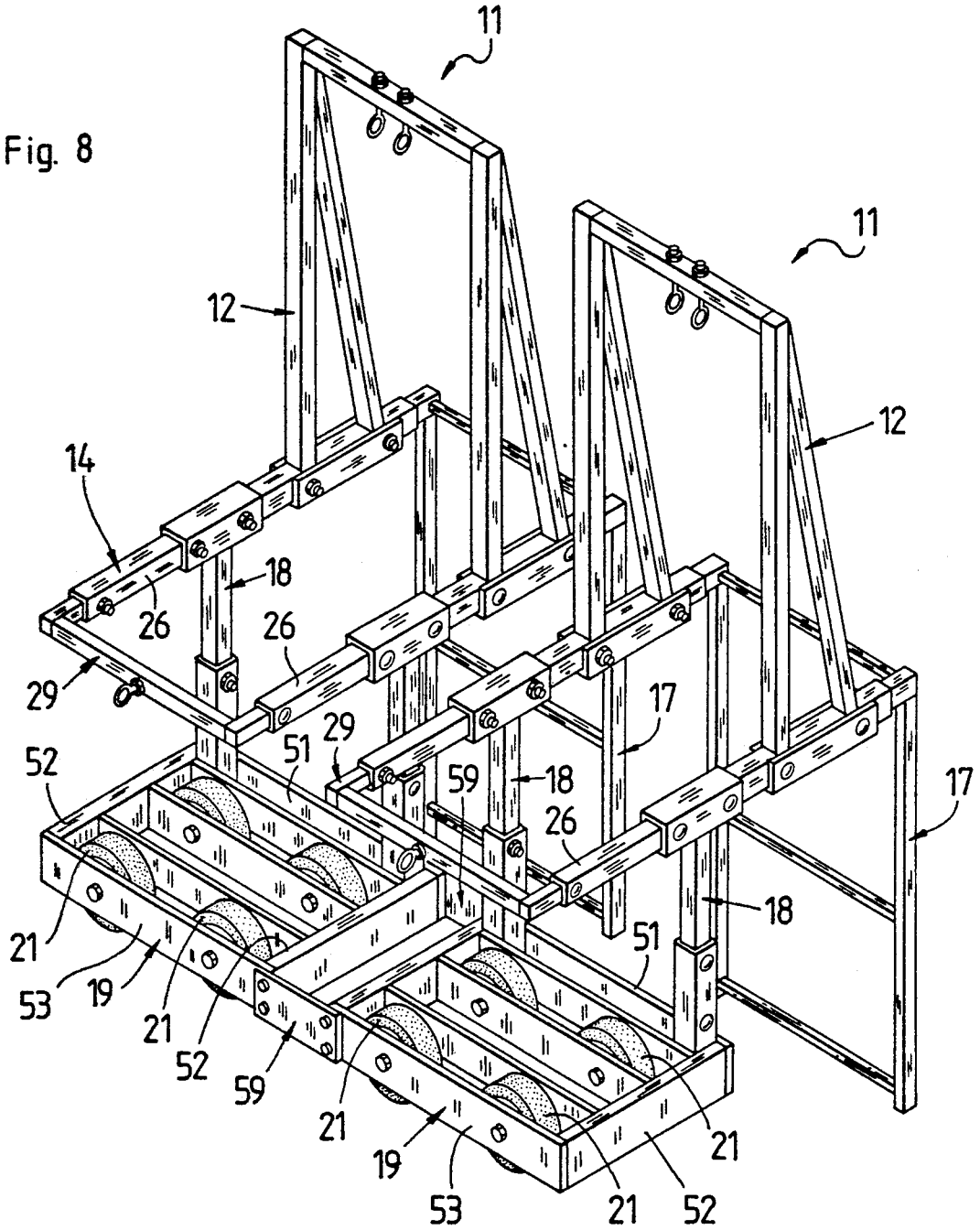
FIG. 8 is a perspective view of a multiple configuration of the invention.
Figure 9:
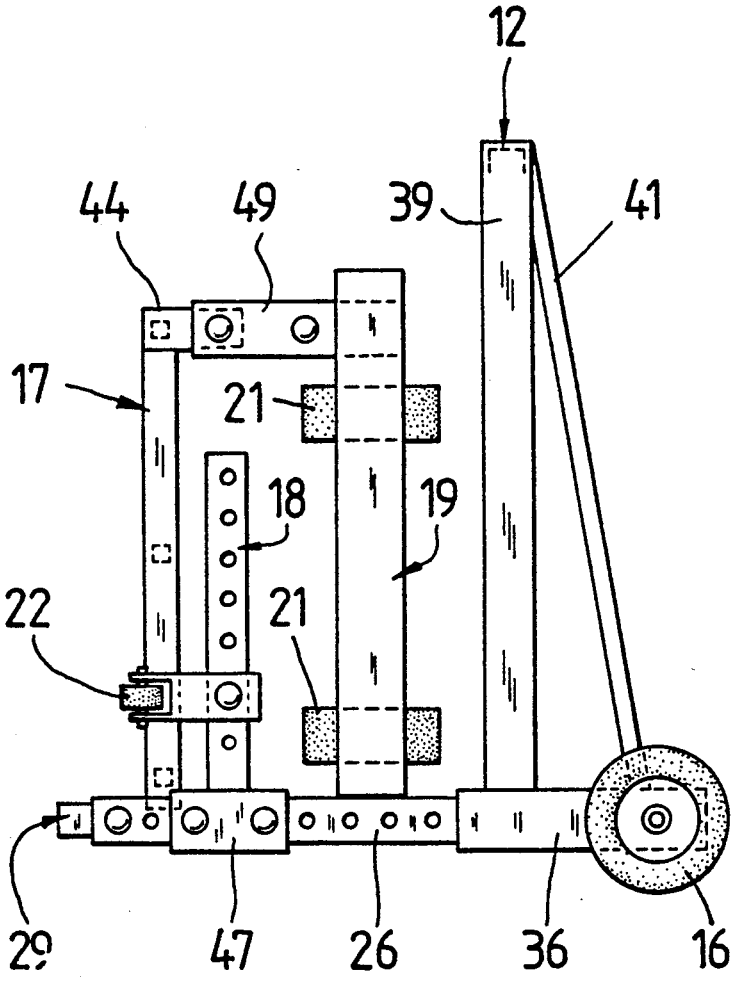
FIG. 9 is a side elevational view of the invention in transport configuration.

As shown in FIG. 8, two of my support structures can be secured to one another by a pair of steel linking plates 59 connected intermediate the adjacent channel members 52 of the balance frame 19 of each support in perpendicular relation thereto. A first worker soaps the windows and the structures are moved so a second worker on the adjacent structure may rinse, cutting the operation in half. The transportation of my invention may be appreciated by referring to FIG. 9. The apparatus may be converted into a dolly having parts secured thereon for transportation or shipment of the apparatus. As illustrated in FIG. 9 the vertical extension members 18 are mounted on the horizontal frame 14 such that the vertical extension members 18 lie parallel to the upright frame 12. Wheels 16 are removed from the apparatus and mounted on wheel frame 34 as shown in FIG. 9. The ladder 17 and balance frame 19 may then be attached for transportation.

In use an operator arrives at the job site with the apparatus partially disassembled for transportation as shown in FIG. 9. The apparatus is set up to engage the wall 13 as shown in FIG. 2. The horizontal and vertical extension arms are adjusted to accommodate the height and width of the parapet wall 13. The operator may add weights 61 to the balance frame or tie the apparatus off to a portion of the building using the eyebolt 33 on the tie-off bar 29 of the horizontal frame.

After the apparatus is assembled and secured on the roof the work and safety lines 45 ar tied off to the eyebolts 57 on the balance frame. The lines are passed through the eyebolts 43 on the upright frame 12 and then lowered over the edge of the wall. Note the line 45 is secured to the apparatus and is not vertically adjustable to facilitate the washer's descent along the vertical surface of the building. The washer uses a harness, in which he sits, that has a repelling device thereon that allows the washer to move downward along the stationary line and face of the building. The washer attaches himself to the harness, on the roof which is secured to the line. He then steps over the edge of the building on to the step ladder and into position to begin cleaning. As the washer cleans, a second operator positioned on the roof can push the support structure along the roof, so the washer may move horizontally across the face of the building, however, if the apparatus is properly balanced the suspended worker may move the apparatus by walking on the face of the wall.

Figure 6:
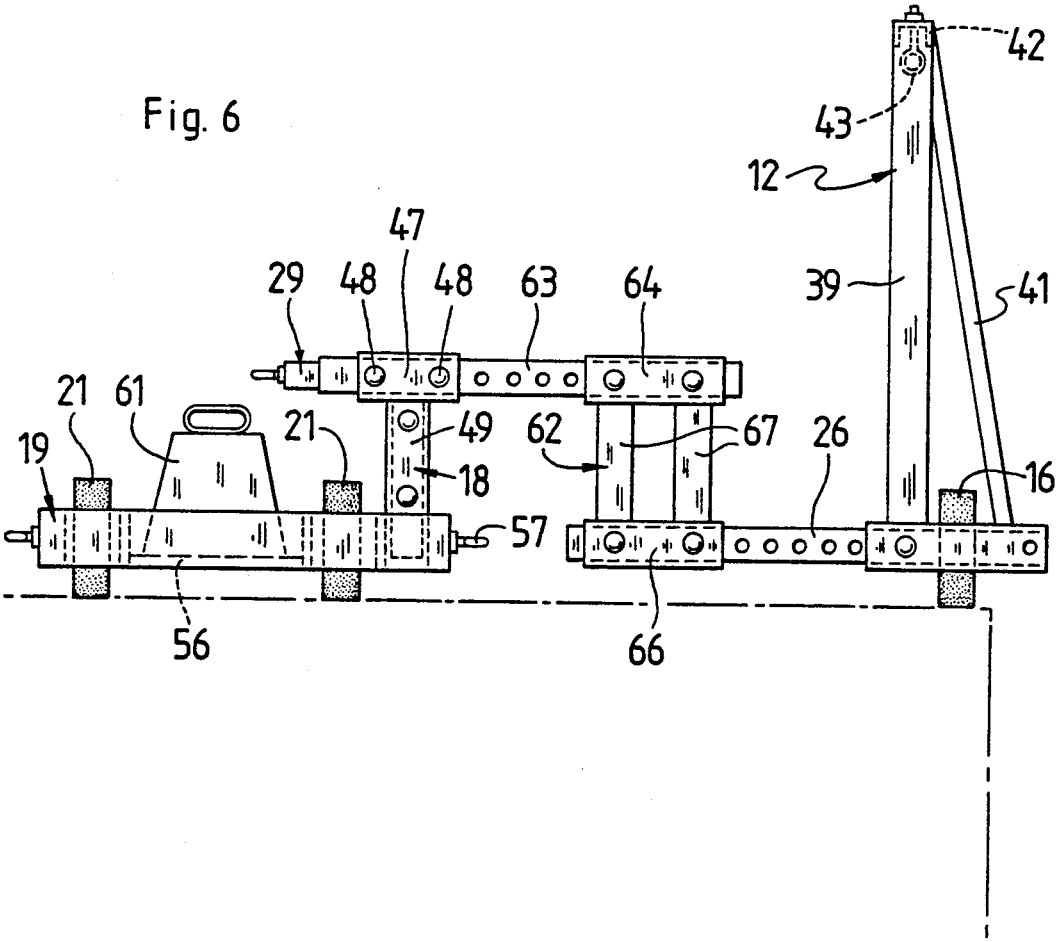
FIG. 6 is a side elevational view of an embodiment of the invention.

As the operator is suspended over the edge of the wall the upright frame 12 directs the line of action through the wheels 16 and into the parapet wall 13. In addition, the attachment of the line 45 to the eyebolts 51 and 43 symmetrically distributes the force applied by the washer on the support structure 12 so the entire apparatus remains balanced on the parapet wall 13. The force applied is substantially vertical and is directed through the wheels into the parapet wall, and opposed by the wall itself so the apparatus is substantially maintained in equilibrium. Any tilting caused by the horizontal components of the force of the line 45 is countered by the weight of the balance frame 19 and counterweight 61 thereon. This makes contact between the guide rollers 22 and 23 and wall minimal so the entire apparatus is able to freely move on the roof and wall with minimal resistance. My invention is also adaptable to function on flat roof tops as shown in FIG. 6. The horizontal frame 14 is detached from the vertical extension legs 18 and resecured thereto such that the wheels 16 on the horizontal frame 14 rest inwardly of the edge of the roof. The horizontal frame 14 is mounted to a pair of vertically extending connectors 62 and horizontal members 63 that ar secured to the vertical extension legs 18. Each vertically extending connector 62 has an upper tubular member 64 and lower parallel tubular member 66 connected by two vertical bars 67 intermediate the members 64 and 66 and in perpendicular relation thereto. As shown in FIG. 6 the horizontal extension arm 26 extend inwardly of the building edge perpendicular thereto and are bolted within the lower tubular member 66. The extension members 63 extend from the upper tubular member 64 to the tubular member 47 of the vertical extension legs 18 and are bolted therein. This apparatus utilizes a balance frame sufficiently long to counter balance any tilting action. The operation of this embodiment is the same as taught above and the force applied by the weight of the washer is directed into the rooftop of the building.

While I have shown my invention in various forms, it will be obvious to those skilled in the art that it is not so limited but is susceptible of various changes and modifications without departing from the spirit thereof.

What I claim is:

1. An apparatus used in conjunction with a rope and a harness for a window washer washing windows along the side of a building having a parapet wall thereon comprising:

(a) a movable support frame supported on the roof and parapet wall of the building with said frame directing the line of action of a force applied by the weight of a window washer substantially downwardly into the parapet wall;

(b) means mounted to said support frame for guiding said support frame along the parapet wall; and (c) a ladder mounted to said support frame allowing the window washer to step over and descend the parapet to begin cleaning.

2. An apparatus as defined in claim 1 wherein said support frame comprises:

(a) a horizontal frame extending over the top surface of the parapet wall inwardly of said wall in perpendicular relation thereto, supported on said top surface by a set of wheels, with said horizontal frame being adjustable in length, and said ladder mounted to an end thereof adjacent the outer surface of said wall;

(b) an upright frame mounted to that portion of said horizontal frame above the wall such that said upright frame extends upward in the same vertical plane as the parapet wall with said upright frame supporting a rope such that the line of action of the weight of a window washer suspended on said rope is downward into the parapet wall;

(c) a pair of vertical extension legs mounted to the upper horizontal frame inwardly of the wall and extending downwardly parallel to said wall; and (d) a balance frame mounted to the base of said vertical extension legs and extending inwardly of said wall in perpendicular relation thereto having wheels mounted thereon, such that said balance frame may roll along the roof.

3. An apparatus as defined in claim 2 wherein said upper horizontal frame includes an opposing pair of horizontal extension arms, extending above the top of the wall and inwardly of said wall in perpendicular relation thereto, a wheel frame mounted intermediate said horizontal extension arms carrying said wheels superjacent parapet wall with said set of wheels mounted thereon resting on the parapet wall supporting the horizontal frame.

4. An apparatus as defined in claim 3 wherein said wheel frame comprises:

(a) an opposing pair of channel members engaging said horizontal extension arms of said horizontal frame above said wall; and (b) an opposing pair of support bars connected intermediate said channel members in perpendicular relation thereto with a set of wheels rotatably mounted to said support bars such that the axes of said wheels are in perpendicular relation to said wall.

5. An apparatus as defined in claim 4 wherein said upright frame further comprises:

(a) a vertical support affixed to each horizontal member inwardly of the wheels, and extending upwardly in same vertical plane as the wall; and (b) a rope support member intermediate the top of said supports in perpendicular relation thereto, with said rope mounted to said rope support to direct the line of action of force applied by the weight of the washer, through the support wheels and into the parapet wall.

6. An apparatus as defined in claim 5 wherein said vertical extension legs have a tubular member transversely mounted to the top thereof said tubular member selectively connected to the horizontal extension arm inwardly of the wall adjacent said wheel frame such that said vertical extension leg extends downwardly parallel the wall.

7. An apparatus as defined in claim 6 wherein said guiding means comprises:

(a) a plurality of inner guide rollers mounted to said vertical extension legs to engage the inner surface of said parapet wall; and (b) a plurality of guide rollers mounted to said ladder and downwardly offset of said inner guide rollers and to engage the exterior surface of said parapet wall.

8. An apparatus used in conjunction with a rope and harness utilized by window washers when hanging over the edge of a building having a parapet wall said apparatus comprising:

(a) movable upright frame supported on a parapet wall be a plurality of wheels mounted thereon which engages said parapet wall and with said upright frame extending upwardly in the same vertical plane as said parapet wall to direct the line of action applied by the weight of the washer substantially downwardly into the wheels and parapet walls;

(b) means for guiding said upright frame along the parapet wall;

(c) a horizontal frame mounted to said upright frame proximal the top of said parapet wall such that said horizontal frame extends from the outer edge of said parapet wall inwardly of the wall in perpendicular relation thereto with said means for guiding being horizontally adjustable on said horizontal frame to accommodate varying widths of parapet walls and further supported on said wheels to maintain said upright frame on said wall; and (d) an opposing pair of vertical extension legs mounted to the upper horizontal frame inwardly of the wall, depending downwardly parallel the wall and mounted to a balance frame that is supported on an adjacent roof by a set of wheels with said vertical extension legs being adjustable to accommodate varying heights of the parapet walls.

9. An apparatus as defined in claim 8 further comprising a ladder depending from the said horizontal frame adjacent the outer surface of the parapet wall.

10. An apparatus as defined in claim 9 wherein said upright frame includes:

(a) an opposing pair of vertical support members mounted to said horizontal frame inwardly of said wheels and extending upwardly in the same vertical plane as said wall; and (b) a rope support bar extending from the top of one vertical member to the top of the second vertical member in perpendicular relation thereto and parallel the top surface of the wall.

11. An apparatus as defined in claim 10 wherein said horizontal frame has an opposing pair of horizontal extension arms affixed to the base of each vertical support member with said horizontal arms extending from the outer surface over the top surface of the wall integral with a wheel frame having wheels mounted thereon and supporting said upright frame on said parapet wall said horizontal extension arms further extending inwardly of said wall in perpendicular relation thereto.

12. An apparatus as defined in claim 11 wherein said vertical extension legs further include a tubular member adjustably engaging said horizontal extension arm inwardly of the wall such that said vertical extension legs depend downwardly parallel the wall.

13. An apparatus as defined in claim 12 wherein said guiding means comprises:

(a) a plurality of inner guide rollers mounted to said vertical extension legs engaging the inner surface of said parapet wall; and (b) a plurality of outer guide rollers mounted to said ladder and engaging the outer surface of said wall.

14. An apparatus as defined in claim 13 wherein said balance frame comprises an opposing pair of end plates parallel to the wall and an opposing pair of channel members connected therebetween in perpendicular relation thereto forming a rectangular frame with the vertical extension legs slidably mounted proximal the wall, and a pair of eyebolts spaced equidistantly from the center of the steel plate adjacent the wall.

15. An apparatus used in conjunction with a rope and harness window washers utilize when washing windows of buildings which have a parapet wall on the roof, comprising:

(a) an upright frame movable along the parapet wall extending upwardly in substantially the same vertical plane of said wall with said upright frame directing the force applied by the weight of the operator downwardly into the upper surface of the parapet wall;

(b) means mounted to said upright frame for movably supporting said upright frame on the parapet wall;

(c) means for guiding said upright frame along the parapet wall; and (d) a ladder mounted to said upright frame such that said ladder depends below the outer edge of said wall in parallel relation to said wall.

16. An apparatus as defined in claim 15 wherein said means for supporting the upright frame on the parapet wall comprises a horizontal frame extending above the top of the parapet wall inwardly of the wall in perpendicular relation thereto, and having a plurality of wheels mounted thereon resting atop the wall supporting said upright frame on the wall.

17. An apparatus as defined in claim 16 wherein said apparatus further comprises a pair of vertical extension legs adjustably mounted to said horizontal frame inwardly of the parapet wall and depending downward parallel to said parapet wall, and adjustably mounted to a balance frame on the roof extending inwardly of the parapet wall and said balance frame supported on the roof by a set of wheels mounted to said balance frame.

18. An apparatus as defined in claim 17 wherein said guiding means includes a plurality of inner guide rollers mounted to the vertical extension legs engaging the inner surface of the parapet wall and a plurality of external guide rollers mounted to the ladder engaging the outer surface of the parapet wall.

19. A device as defined in claim 18 wherein said horizontal frame comprises a pair of horizontal extension arms with said arms extending from the outer surface of said parapet wall inwardly in perpendicular relation thereto, a wheel frame adjustably mounted intermediate said horizontal extension arm and a plurality of wheels mounted on said wheel frame superjacent the parapet wall resting on said parapet wall so said upright may roll along said parapet wall.

20. An apparatus as defined in claim 19 wherein said upright comprises:

(a) a vertical support member affixed to each horizontal extension arm inwardly of the wheels, extending upward in the same vertical plane of the parapet wall perpendicular said horizontal extension arm and parallel to the other vertical support member;

(b) a rope support mounted intermediate the top of said vertical support members in perpendicular relation thereto, and parallel to the top surface of the parapet wall.

* * * * *